US010202752B2

(12) United States Patent
Dunster

(10) Patent No.: US 10,202,752 B2
(45) Date of Patent: Feb. 12, 2019

(54) BUILDING CONSTRUCTION

(71) Applicant: ZERO BILLS HOME LIMITED, Greater London (GB)

(72) Inventor: William Robert Dunster, Surrey (GB)

(73) Assignee: ZERO BILLS HOME LIMITED, Greater London (GB)

( * ) Notice: Subject to any disclaimer, the term of this patent is extended or adjusted under 35 U.S.C. 154(b) by 0 days.

(21) Appl. No.: 15/539,278

(22) PCT Filed: Dec. 20, 2015

(86) PCT No.: PCT/IB2015/059807

§ 371 (c)(1),
(2) Date: Jun. 23, 2017

(87) PCT Pub. No.: WO2016/103137

PCT Pub. Date: Jun. 30, 2016

(65) Prior Publication Data

US 2018/0023283 A1 Jan. 25, 2018

(30) Foreign Application Priority Data

Dec. 24, 2014 (GB) ..... 1423199.7

(51) Int. Cl.
*E04B 1/26* (2006.01)
*E04B 1/18* (2006.01)
(Continued)

(52) U.S. Cl.
CPC ..... *E04B 1/18* (2013.01); *E04B 1/185* (2013.01); *E04B 1/24* (2013.01); *E04B 1/26* (2013.01);
(Continued)

(58) Field of Classification Search
CPC . E04B 1/18; E04B 1/2426; E04B 1/26; E04B 1/2608
See application file for complete search history.

(56) References Cited

U.S. PATENT DOCUMENTS 1,562,784 A * 11/1925 Olsen ..... E04B 1/41 52/370
2,302,194 A * 11/1942 Dayton ..... E04B 1/2608 403/217
(Continued)

FOREIGN PATENT DOCUMENTS

WO 2005/040516 A1 5/2005

OTHER PUBLICATIONS

International Search Report, dated Apr. 6, 2016, issued in Internationai Application No. PCT/IB2015/059807.

*Primary Examiner* — Paola Agudelo
(74) *Attorney, Agent, or Firm* — Saul Ewing Arnstein & Lehr LLP

(57) ABSTRACT

A building is constructed from a plurality of rectangular wall sections secured to one another. At least some wall sections are formed of an upper and a lower beam, vertical studs extending between the upper and lower beams and a wall panel secured to the beams and to the studs. In the invention, each beam is formed of an elongate metal sheet folded through a right angle about at least one longitudinally extending line to define at least a horizontal first plate, and a vertical second. A plurality of separately formed sheet metal brackets are secured to at least one of the plates of the folded metal sheet at preset distances from one another along the length of the beam and secured to the ends of the studs.

13 Claims, 4 Drawing Sheets

(51) Int. Cl.

| | |
|---|---|
| ***E04B 1/24*** | (2006.01) |
| ***E04B 7/02*** | (2006.01) |
| ***E04B 5/10*** | (2006.01) |
| *E04B 7/04* | (2006.01) |
| *E04B 5/12* | (2006.01) |
| *E04C 3/06* | (2006.01) |
| *E04C 3/09* | (2006.01) |

(52) U.S. Cl.
CPC ..... *E04B 1/2608* (2013.01); *E04B 1/2612* (2013.01); *E04B 5/10* (2013.01); *E04B 7/024* (2013.01); *E04B 5/12* (2013.01); *E04B 7/045* (2013.01); *E04B 2001/249* (2013.01); *E04B 2001/2415* (2013.01); *E04B 2001/2463* (2013.01); *E04B 2001/2469* (2013.01); *E04B 2001/2484* (2013.01); *E04B 2001/2644* (2013.01); *E04C 3/065* (2013.01); *E04C 3/09* (2013.01)

(56) References Cited

U.S. PATENT DOCUMENTS 3,668,828 A * 6/1972 Nicholas ..... E04B 1/26 52/639
3,777,426 A * 12/1973 Weiner ..... E04B 1/2403 52/274
4,356,675 A * 11/1982 Reicherts ..... E04B 1/34336 52/264
5,274,973 A * 1/1994 Liang ..... E04B 2/58 52/243
5,353,560 A * 10/1994 Heydon ..... B26D 3/006 52/241
5,765,330 A * 6/1998 Richard ..... E04B 1/14 52/265
7,159,369 B2 * 1/2007 Elderson ..... E04B 2/7457 52/481.2
7,310,914 B1 * 12/2007 Moore ..... E04B 1/3483 52/289
7,398,620 B1 * 7/2008 Jones ..... E04B 7/045 52/643
7,694,483 B1 * 4/2010 Tucker ..... E04C 3/28 52/280
7,712,267 B2 * 5/2010 Lehane ..... E04B 2/7453 52/169.5
8,061,088 B2 * 11/2011 Walker ..... E04B 7/045 403/403
8,448,348 B1 * 5/2013 Jones ..... E04G 21/1891 33/613
8,448,395 B2 * 5/2013 Ivarsson ..... E04B 2/767 52/210
2002/0095906 A1 * 7/2002 Edmondson ..... E04G 21/1891 52/745.05
2005/0144900 A1 * 7/2005 Hallissy ..... E04B 1/98 52/782.1
2005/0183383 A1 * 8/2005 Jones ..... E04B 7/022 52/745.1
2010/0132272 A1 6/2010 Posey
2014/0026508 A1 * 1/2014 Niemann ..... E04B 1/165 52/405.3
2018/0038121 A1 * 2/2018 Youngborg ..... E04G 21/16

* cited by examiner

BUILDING CONSTRUCTION

CROSS REFERENCE TO RELATED APPLICATIONS

This application claims the priority of PCT/IB2015/059807, filed on Dec. 20, 2015, which claims the benefit of priority to Great Britain Application No. GB 1423199.7, filed on Dec. 24, 2014, the entire contents of each of which are fully incorporated herein by reference.

FIELD OF THE INVENTION

The present invention relates to the construction of buildings.

BACKGROUND OF THE INVENTION

It has previously been proposed to simplify and speed up construction of a timber or composite cellulosic fibre framed building, such as a house, by manufacturing and pre-assembling complete sections in a factory and assembling the sections on site. This technique reduces the need to employ skilled labour on site and the automated manufacture of the sections in a factory allows improved quality, because parts can be cut and assembled to close tolerances.

However, though assembly time is reduced on site, the total time taken to construct a building, that is to say from its conception to its completion, is to be measured in months rather than days. Architect drawings need first to be sent to the manufacturer of the building sections. From these plans, the manufacturer needs to generate the machine instructions required for the production of the parts that are to be assembled into each section. Such machine instructions will, for example, be used to cut timber to the desired dimensions and to make holes in the timber in the places specified by the architect plans. After they have been factory assembled, the "flat pack" sections must then be shipped to the site where the building is to be erected, and detailed instructions must be prepared for sending to the crew responsible for erecting the building by assembling the pre-manufactured sections.

DESCRIPTION OF THE PRIOR ART

WO02005/040516 discloses a building element connection and spacing device including a strip member of substantially inextensible material, a connector located at at least one longitudinal position on said member for providing a connection between orthogonal building elements, and at least one index at a longitudinal position on said member corresponding to an element spacing distance. In one form, a plurality of the devices are adapted to be laid end-to-end to provide a series of building element connections at fixed intervals, such as those between a wall frame top member and a series of roof trusses, a bearer member and floor joists or between a wall frame bottom member and uprights.

OBJECT OF THE INVENTION

The present invention seeks to enable a building to be erected rapidly and inexpensively, using standard components yet without extensive reliance on skilled labour.

SUMMARY OF THE INVENTION

In accordance with the present invention, there is provided a method of constructing a studwork wall section that has upper and lower beams, studs extending vertically between the upper and lower beams and a wall panel secured to the upper and lower beams and to the studs, which method comprises providing studs of uniform length, providing structural support beams each formed of an elongate metal sheet folded through a right angle about at least one longitudinally extending line to define at least a horizontal first plate, and a vertical second plate to be secured to the wall panel of the studwork wall, each beam having been pre-fitted with a plurality of separately formed sheet metal L-shaped or U-shaped brackets that are permanently secured to at least one of the plates of the folded metal sheet at preset distances from one another along the length of the beam, securing a plurality of studs between two beams by fixing each end of each stud to one of the brackets on a respective one of the beams so that the studs lie parallel to one another, and securing a wall panel to the two beams and the studs, the dimensions of the wall panel ensuring that the studs and the beams lie at right angles to one another.

In the present invention, the beams used in the construction of the building, and in particular in its perimeter wall, are designed not only to serve as an essential structural support element of the building but as an assembly jig for the remaining components of the studwork walls. This is to be contrasted with the connection and spacing device of WO2005/040516 which does not serve as a structural element and serves only to connect two elements to one another, the elements providing the necessary structural support rather than the connection device. Furthermore, the prior art connection device has no means of connection to the wall panels and serves only to secure together the frame of the studwork walls.

Conveniently, prior to securing studs to the beams, the beams are supported generally parallel to one another on a non-vertical, preferably horizontal, surface.

Once two such wall sections have been assembled, a self supporting corner of a building may be formed by temporarily holding the two wall sections in a vertical attitude and in mutually inclined planes, and securing adjacent lateral edges of the two wall sections to one another. Starting from a corner, the remainder of a building can be constructed by adding further wall section and securing their vertical adjacent lateral edges to one another.

In a second aspect, the invention provides a structural support beam for enabling construction at a building site of a studwork wall section that comprises two load bearing beams, studs extending parallel to one another between the beams to form a frame and a wall panel secured to the frame, wherein the beam is formed of an elongate metal sheet folded through a right angle about at least one longitudinally extending line to define a vertical plate having an outwards facing side to be secured to the wall panel of the studwork wall and at least one horizontal plate projecting inwards from the vertical plate, wherein the beam is fitted, prior to arrival at the building site, with a plurality of separately formed sheet metal L-shaped or U-shaped brackets that are permanently secured to at least one of the plates of the folded metal sheet at preset distances from one another along the length of the beam, the brackets being located entirely inwards of the vertical plate.

The beam allows wall sections of a standard size to be assembled on site without requiring skilled labour while yet achieving wall sections that are all, within a minimal tolerance, both of the same size as one another a square. This consistency is achieved because the spacing between the stud fixing brackets is not determined on site but during the manufacture of the beams under tightly controlled conditions and using purposely designed equipment. The studs and wall panels are all pre-cut to standard dimensions so that fixing the studs to beams ensures that the beams will always be the correct distance apart and that the height of the wall section will be constant. Last, the size of the wall panel ensures that the when fixed the beams and the studs, it will constrain the wall section to be square with all the studs accurately perpendicular to the beams.

The design of the beams may vary depending on the position of the beam in a building.

In the case of a beam intended to be secured the lower edge of a wall panel, the beam may comprise an elongate metal sheet bent about a longitudinally extending fold line to form horizontal and vertical plates and the brackets for fixing to the studs may be secured to both the horizontal and vertical plates of the metal sheet. In this case, the horizontal plate of the beam may additionally have a downwardly bent return along the inwards facing edge to fit over the edge of a foundation wall.

The horizontal plate of a beam may extend further from the vertical plate that the stud mounting brackets to provide a region to which a floor may be secured.

In the case of a beam intended to be secured to the upper end of a wall section to serve as a lintel for supporting an upper storey or a roof, the beam may comprise an elongate metal sheet bent to form two horizontal and one vertical plate, and the brackets for fixing to studs being secured to the lower of the two horizontal plates to project downwards. Brackets capable of being screwed to joist may additionally be mounted between and secured to both horizontal plates in vertical alignment with the stud mounting brackets.

It is advantageous of the elongate metal sheet and the brackets may be cut by any method used in accurately cutting sheet metal, such as laser, water jet or spark erosion. The stud brackets may be secured in place by rivets inserted into aligned holes. Such a method of manufacture ensures uniformity of the beams, within tight tolerances.

In an embodiment of the invention, at least two tabs are bent out of the plane of the vertical plate of the metal sheet to project, horizontally level with one another, in the opposite direction from the horizontal plate(s) of the metal sheet, to support the lower edge of the wall panel of the studwork wall. Such tabs both allow a wall panel to be supported correctly if it is being secured to the studs while in a vertical attitude and when a wall panel is fitted between tabs projecting from a floor and a ceiling beam, it ensures that the frame formed by the studs and the beams is accurately square before the wall panel is fixed in position.

The terms "vertical" and "horizontal" as used herein refer to the orientation of the plates when the beam is installed as part of a building.

Where appropriate, the latter U-shaped brackets may be used to secure ceiling joists to the lintel beams. In the latter case, it is desirable to form cut-out slots in the upper horizontal plate of the C-shaped lintel in alignment with the joist mounting brackets, to enable the joists to be dropped into the mounting brackets from above.

When constructing a building with more than one storey, the upper horizontal plate of the lintel beam of the lower storey may be secured to a base beam of the next upper storey. The base beam of the lowest storey may be formed with a downwardly bent return along the inwards facing edge of its horizontal plate to fit over the edge of a foundation wall while the base beam of an upper storey may have an inwardly extended horizontal plate to provide a region to which a floor of the upper storey may be secured.

In the present invention, the beams used in the construction of the building, and in particular in its perimeter wall, are designed not only to serve as an essential structural support element of the building but as an assembly jig for the remaining components of the studwork walls. The precise assembly of the stud fixing brackets to the metal sheet of each beam ensures that the studs are parallel and correctly spaced, without the need for any measurement at the time of construction. Furthermore, any U-shaped brackets are dimensioned to be a nice fit on the studs, thereby ensuring that they are positioned perpendicular to the beam.

It is envisaged that, aside from the various sheet metal beams, the remaining components used in the construction of the studwork walls will be standard components such as studs of standard cross section accurately pre-cut to standard lengths and rectangular sheets of plywood or OSB (oriented strand board) board, once again accurately pre-cut to standard sizes. The studs may be made of metal but it is preferred that they be made of a wood or other fibrous material.

The beams may come in standard lengths, corresponding to whole number multiples of one half of the width of the wall panels. Consequently, wall sections constructed using any length of beam will always have a stud at each end to which the wall panel may be screwed.

Wall sections may be constructed in a vertical attitude but when forming the first corner of a building, it is simpler to construct two wall sections in a horizontal attitude then to raise them into a vertical attitude and secure them to one another by securing the contacting studs of the two wall sections to one another. The remainder of the perimeter may then be built by constructing further sections as required and securing them, side to side, to the previously erected wall sections.

The stud fixing brackets may be spot welded or seam welded to the L-shaped metal sheet of the beam but it is preferred to rely on riveting. Thus the base portion of the brackets may be secured to one of the plates of the folded metal sheet by rivets. To secure one of the upright limbs of an L-shaped or U-shaped bracket to a plate of the metal sheet, the end of the limb may be folded to form a flange that is riveted to one of the plates of the metal sheet.

Larger holes may also be formed in at least one of the horizontal and vertical plates of the metal sheet to allow the passage of pipes and wires.

After having assembled and erected a first floor of a building from rectangular wall sections, in the manner described above, it is necessary to provide a reinforcement beam or lintel, surrounding the perimeter of the building to support the roof structure of the next higher storey of the building.

When assembling a single floor building, lintel beams are used for the upper edge of each wall section and base beams are used for the lower edge of each wall section. When the wall sections are assembled to one another, a perimeter metal reinforcement is automatically created at the top of the wall sections of the first floor which can support the roof structure and has brackets already in place for receiving the joist onto which boards may be secured to form a ceiling for the first floor. The floor boards that are subsequently secured to the upper sides of the joists strengthen the perimeter walls against bowing outwards or inwards.

It may be seen from the above description, that using basic sheet metal beams with accurately positioned stud mounting brackets, the invention enables the framework of a building to be constructed using standard components available from any timber yard, such as joists and studs cut to preset lengths and wall and ceiling panels of standard dimensions.

BRIEF DESCRIPTION OF THE DRAWINGS

The invention will now be described further, by way of example, with reference to the accompanying drawings, in which.

DETAILED DESCRIPTION OF THE DRAWINGS

Figure 2:
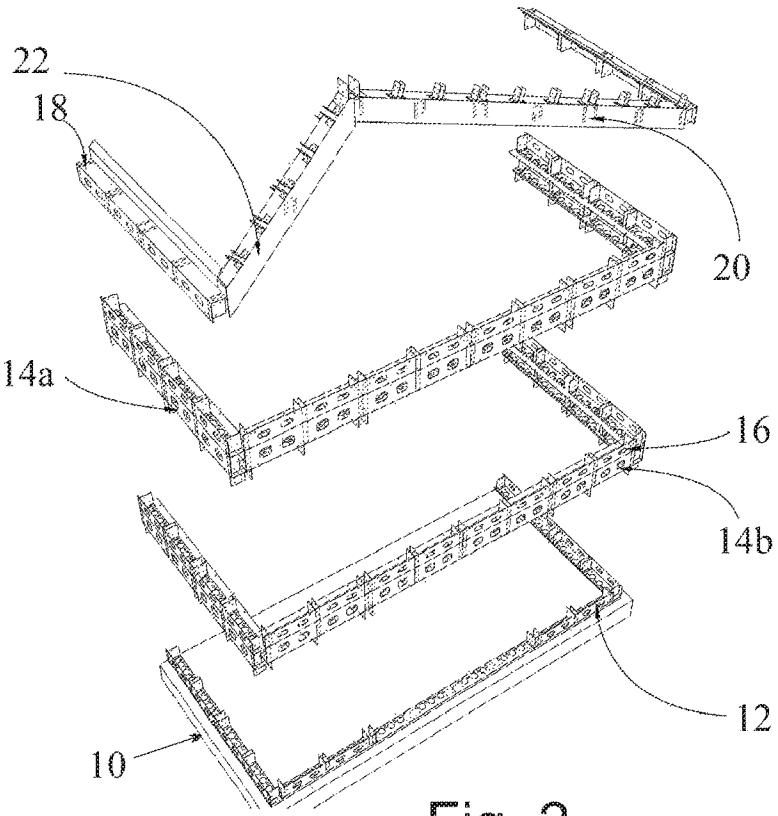
FIG. 2 is a view showing only the sheet metal beams of the building shown in FIG. 1.
Figure 1:
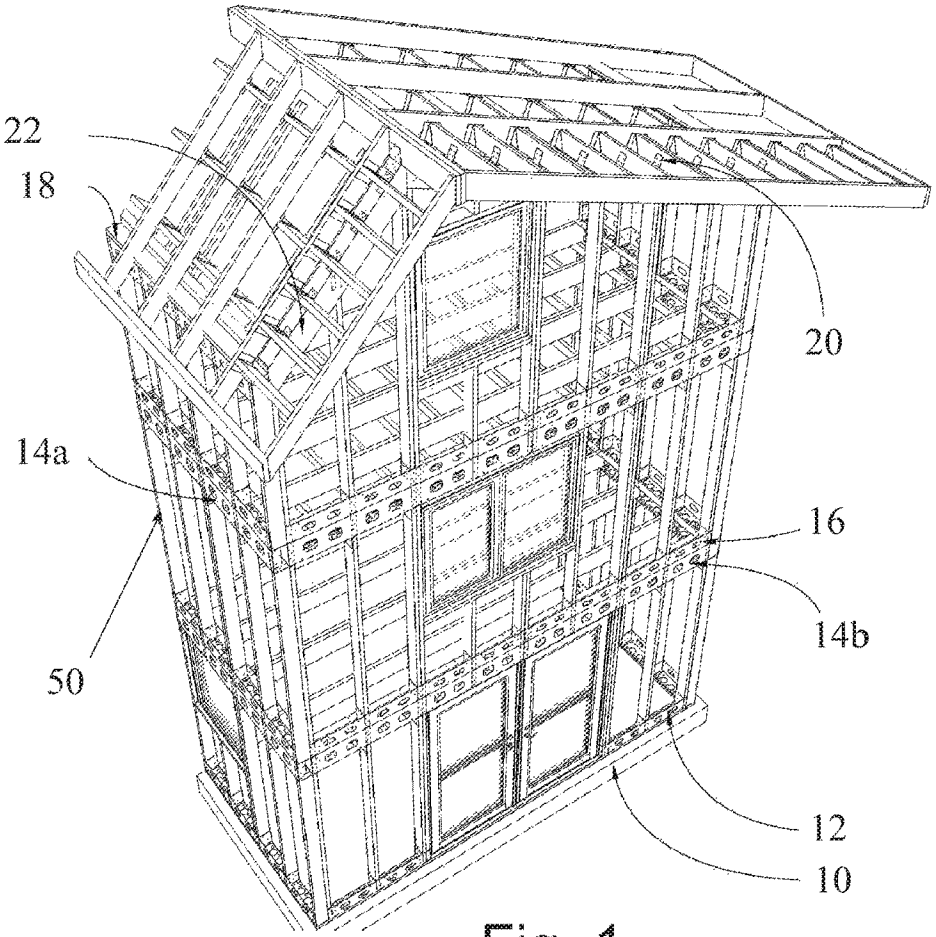
FIG. 1 is a perspective view of the frame of a building constructed using beams of sheet metal and vertical studs, joists and rafters made of wood.

The building framework shown in FIG. 1 is made up of the galvanised steel beams shown in FIG. 2, which may be powder coated and studs, joist and rafters made of wood or or composite cellulosic fibre. The sheet metal beams are constructed in accordance with different embodiments of the invention whereas the remaining components are stock items that can be purchased from a timber yard.

The beams of the different embodiments of the invention are designed for different parts of a building, as will be clear from the description below. The different beams, however, all have in common the fact that they are made of sheet metal, for example 1.5 mm steel, and derive their strength from the fact that the sheet metal has at least one fold to define a horizontal plate and at least one vertical plate, and that they have brackets secured to them at preset distances from one another to connect to the vertical studs of the building.

The stud mounting brackets are fixed to the beam during their manufacture so that, when they arrive at a building site, all the stud mounting brackets are already in place and correctly aligned. This differs from some known systems where stud mounting brackets are affixed to beams on site, often after the beams have already been mounted in situ.

Because of this design of the beams, they act as templates for the assembly of rectangular wall sections that can be assembled one at a time and secured to one another to form the framework shown in FIG. 1. Each wall section is assembled from two beams that are arranged as the top and bottom the wall section. Studs of standard length are screwed to the brackets of the two beams and a wall panel, made for example of vapour permeable formaldehyde-free tongue-in-groove OSB board, is screwed to the vertical plates of the two beams and to the studs that extend between them.

The different beams used in constructing the framework of FIG. 1, include a base beam 12 that is fitted directly to a wooden plinth 10 constructed as part of the building foundation. The top of each wall section on the lowest storey is formed by a lintel beam 14 of which there are two types, namely a joist-bearing lintel beam 14*a* and a non-joist-bearing lintel beam 14*b*.

The wall sections of the higher storeys have a wall beam 16 along their lower edge which is secured to a lintel beam 14 of the storey below. Two further special purpose beams that are required are the roof beams 12 and gables beams 20 and 22.

The different types of beam that are required to construct the framework of FIG. 1 will now be described by reference to FIGS. 3 to 9.

Figure 3:
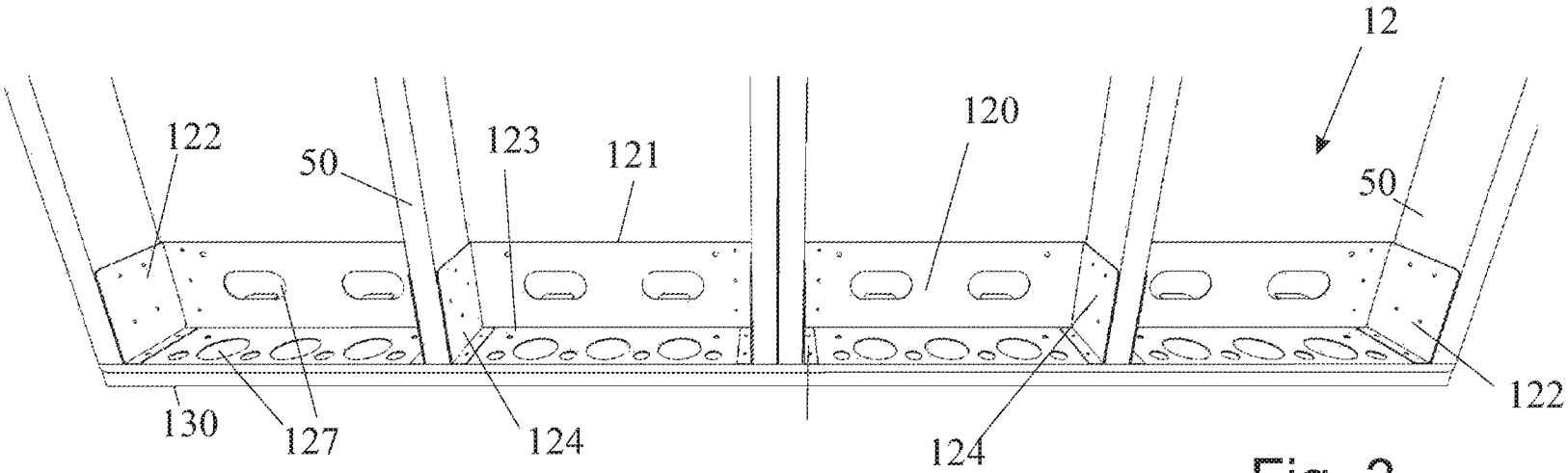
FIG. 3 is perspective view from within of a base beam.
Figure 4:
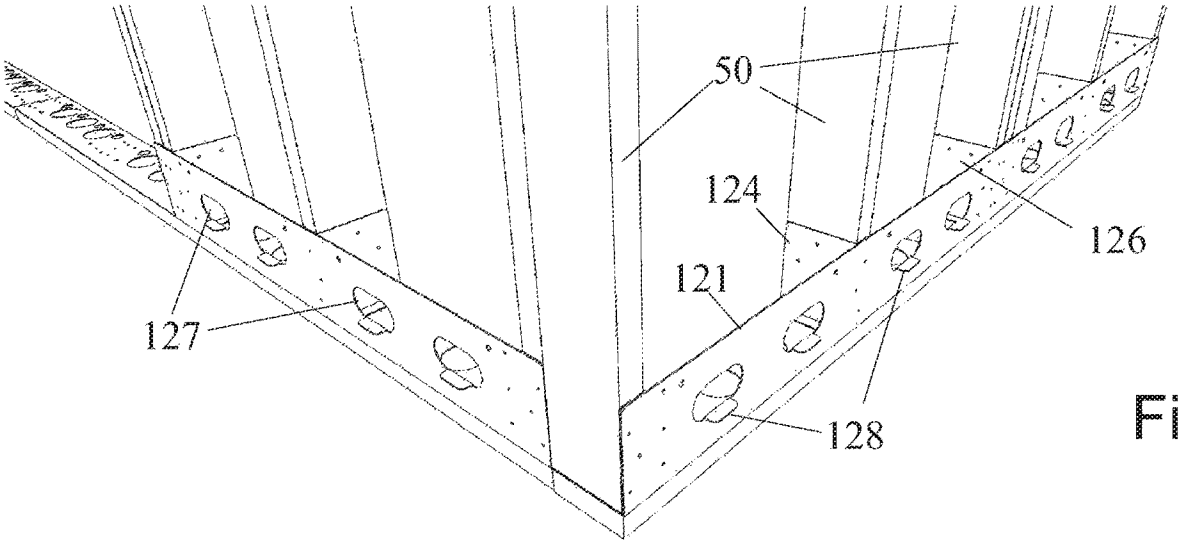
FIG. 4 is a view of two base beams at a corner of the building as viewed from the outside.

FIGS. 3 and 4 show the construction of the base beams 12. Each base beam 12 comprises a metal sheet 120 that is bent into an L-shape to define a vertical plate 121 and a horizontal plate 123. Brackets 122, 124 and 126 intended to be screwed to the studs 50 of the wall section are secured to the vertical and horizontal plates 121, 123. Though the brackets could be welded to the metal sheet 120, it is preferred to form laser cut holes in both the brackets and the metal sheet and to plate rivets in these holes after they have been correctly aligned. The stud brackets include L-shaped brackets 122 for the studs 50 at the lateral ends of a wall section, U-shaped brackets 124 wide enough for one stud 50 and a further U-shaped bracket 126 that is wide enough for two studs 50.

The length of the beam is equal to the combined width of two OSB boards. Two studs 50 are required in the centre of the wall section to allow two OSB boards to be secured to the studs 50.

The horizontal 123 and vertical 121 plates of all the beams 12 are provided with holes 127 for the passage of wires and pipes and if necessary any hole used to pass a wire or a pipe may be fitted with a grommet to prevent chafing.

The lower edges of the holes 126 in the vertical plates 121 of the base plate 12 have outwardly turned tabs 128. These are used to support and located the OSB-boards as they are being screwed in position. As tabs at the top and bottom of each OSB board will be spaced apart by the exact length of the OSB board, there presence will also prevent racking, that it is say it will ensure that the walls sections are all accurately rectangular, with 90° corners.

The base beams 12 additionally have a small return 130 to fit over the wooden plinth 10 which may typically be mounted to a course of bricks.

Figure 5:
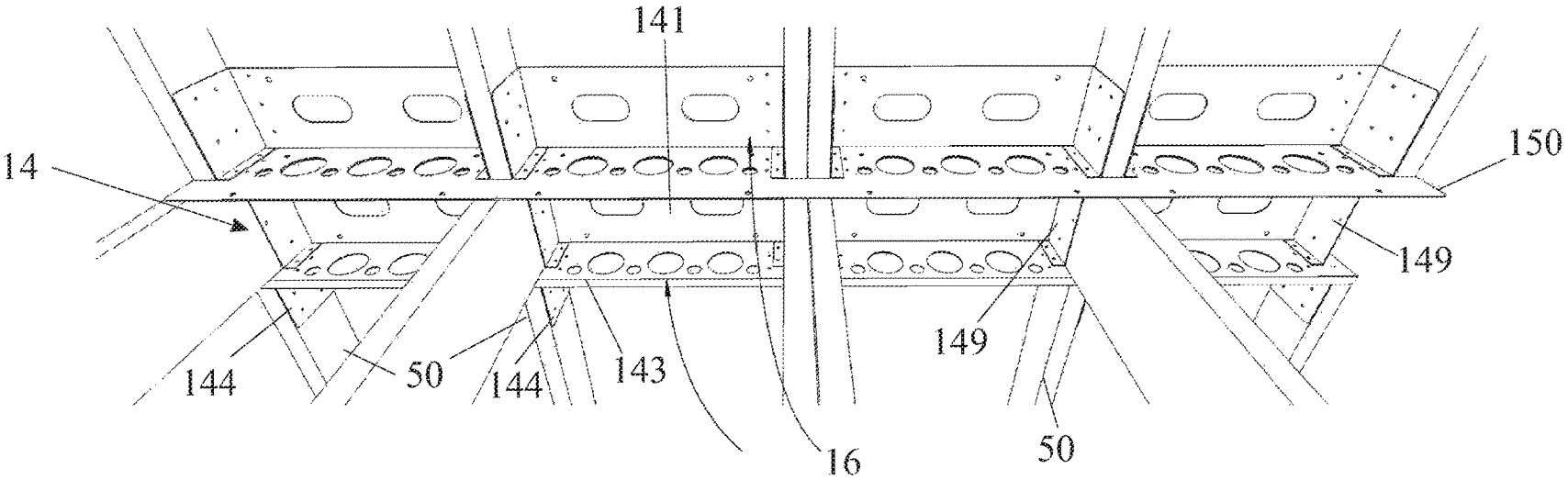
FIG. 5 is a view from within the building of a lintel beam connected to the studs of a lower storey and to ceiling joists and of a wall beam secured to the lintel beam and connected to studs of an upper storey.
Figure 6:
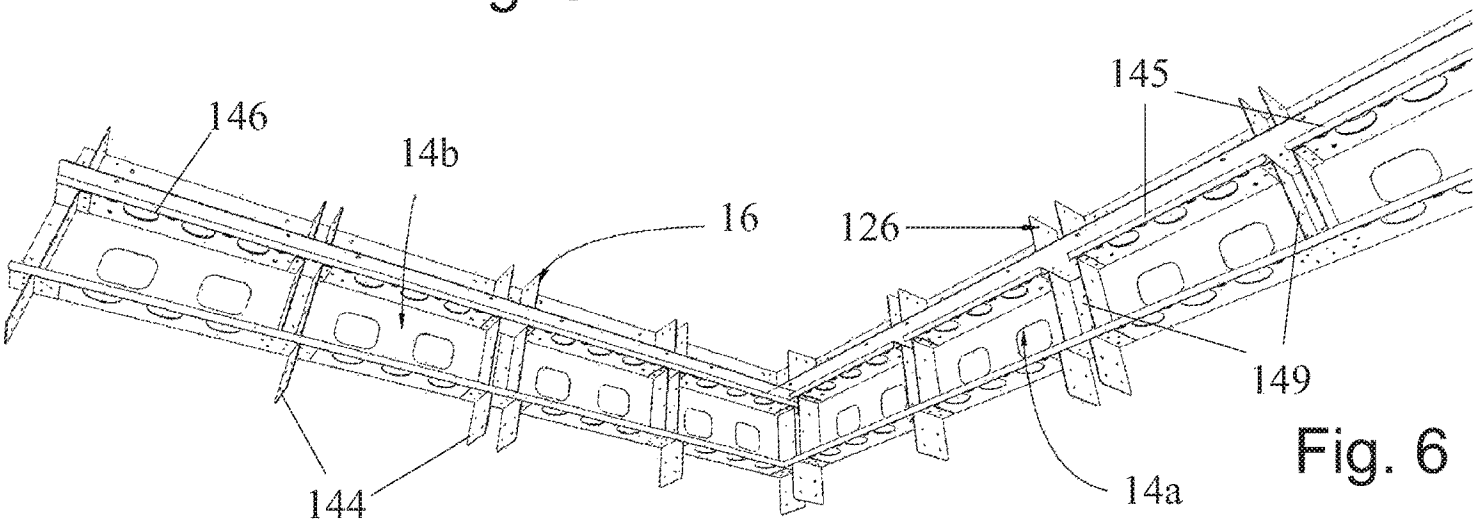
FIG. 6 is a view from within the building of a corner of the perimeter beams meeting at a corner between two storeys of the building.

The lintel beams 14 shown in FIGS. 5 and 6, that are used at the top of each wall section, are required to withstand a higher bending load than the base beams. For this reason, the lintel beams are constructed of C-shaped cross section instead of an L-shaped cross section. The lintel beams have a vertical wall 141 and a lower horizontal wall 143. Brackets 144, that are similar in construction and in positioning to the brackets 122, 124 and 126 of the base plate, depend from the under surface for screwing to studs of the wall section.

The lintel beams also have an upper horizontal plate 145, 146 and brackets 149 that are positioned between the two horizontal plates and are riveted to them. The brackets 149 which are aligned vertically with the brackets 144, may optionally be additionally secured to the vertical plate 141.

In the case of the non-joist-bearing lintel beams 14*b*, the upper horizontal wall 146 is continuous. However, for the joist-bearing beams 14*a*, the upper plate 145 has slots aligned with the brackets 149 so that the joists may be lowered into the brackets 149 from above.

After the joists have been placed within the brackets 149 of a joist-bearing beam 14*a*, a wall plate 16 is riveted to the upper plate 145 of the lintel beam 14*a* to hold the joists in place and strengthen the lintel beam 14*a*. In the case of a non-joist-bearing beam 14*b*, there is no requirement for slots and the upper plate 146 of the lintel beam 14*b* is therefore continuous. In this case, the lintel beam 14*b* may also be pre-assembled to a wall beam 16 instead of being riveted to it on site. The action of riveting or bolting the wall plate component 16 to the joist bearing beam creates additional load bearing capacity enabling the composite assembly to span further over window or door openings.

The wall beams 16 are essentially base beams 12 and differ from the base beams only in the construction of the lower horizontal plate. Instead of having a return to fit over a plinth 10, the horizontal plate of a wall beam 16 is made wider to project beyond the stud brackets and provide a protruding strip 150 to which OSB boards forming the floor boards of the upper storey may be screwed.

Figure 7:
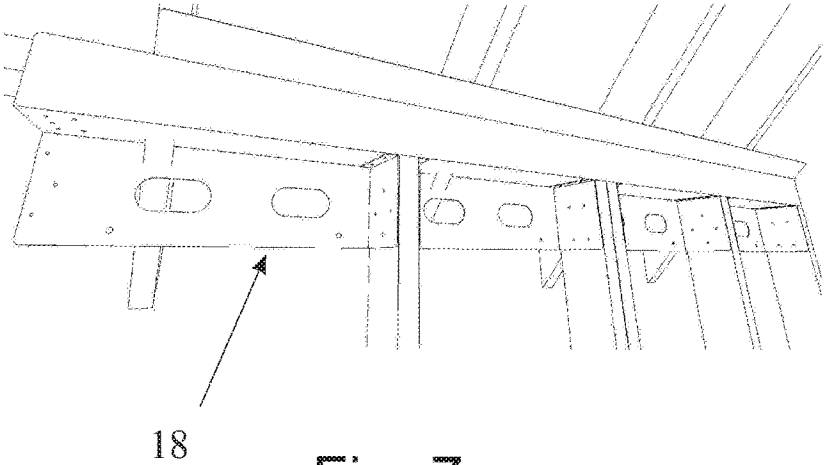
FIGS. 7 and 8 are view of a roof beam.
Figure 8:
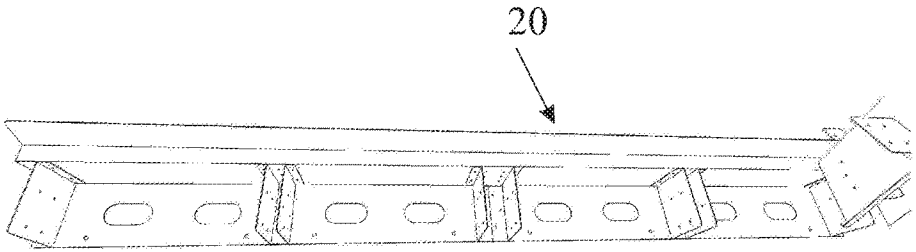
Figure 9:
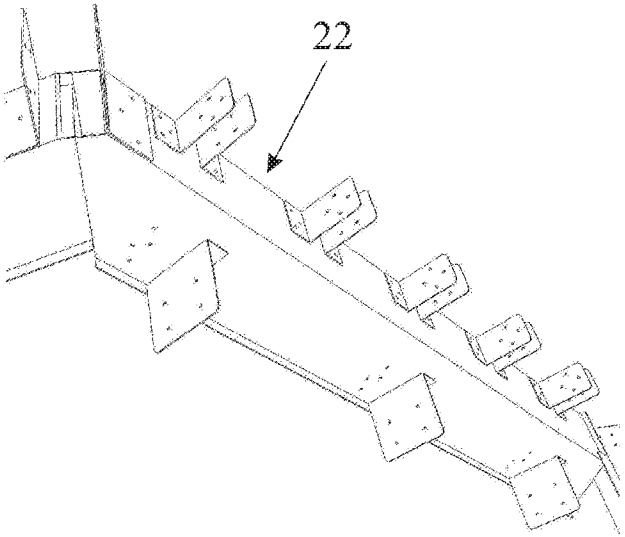
FIG. 9 shows a gable beam.

The roof beam 18 shown in FIG. 7 and the gable beams of FIGS. 8 and 9 are constructed on the same principle as the base and lintel beams. They have a folded elongate sheet metal component for strength and brackets for screwing to studs and rafters, as will be clear from FIG. 1.

Unlike the remaining beams, in the case of the gable beams 20 and 22, the stud brackets do not lie in a plane normal to the longitudinal axis of the of the beam but at an angle that corresponds to the pitch of the roof. The building in FIG. 1 requires two different forms of gable beam 20 and 22 because it has sections of different pitch. It should be noted that the internal axial bearing surface inside the stud brackets is always perpendicular to the vertical span of the stud. This enables axial loads to be transferred from the stud to the roof beam 18 without the need for cutting timbers to the precise inclination of the roof plane. Ordering pre-cut timber studs with perpendicular sawn ends reduces site erection time and reduces the timber stud preparation cost.

Instead of a continuous foundation wall 10, it may in some cases be preferred to insert piles into the ground and to secure a lintel beam to the tops of the piles. In this case, the lowest floor also uses wall beams 16 as base beams and may have joists screwed to the lintel beams to provide a floor for the lowermost storey of the building.

Though only the construction of the perimeter walls is described above, it will be appreciated that a similar structure to that described above may be used for forming interior partition walls.

As above described, the invention enable construction of a framework faced with OSB boards that enclose the entire interior of the building. While doors pre-assembled within frames may be used in place of all or half of a wall section, windows are formed by cutting out holes in the OSB boards and securing window assemblies to the studs and beams that are already in place.

The strength of the building in FIG. 1 is not derived from any single component. Hence, the lintel beams are not required to have, prior to their assembly, the same load-bearing capacity as a conventional concrete lintel or a rolled steel joist. The fact that the beams are secured to studs and wall board increases their resistance to bending and, because they are screwed to the joists and floor boards the walls of the building, they are prevented from bowing in or out. The total weight of the building materials used in the construction is therefore significantly reduced, which in turn reduces the load that needs to be supported by lower storeys.

The reduction in the weight of the building material reduces material costs and also simplifies the foundations required to support the building. Screws driven into the ground to act as piles may suffice to construct a raised raft, allowing the building to be erected in a flood plane.

The framework is also well suited to eco-friendly construction. Insulation, such as mineral wool having a thickness of 150 mm, may be placed within each wall section before an inner wall is secured to the studs.

Though the inner walls may be made constructed in a conventional manner, for example using plaster board or a suitable sheet insulating system, it is preferred to use sheets of cork. Cork is currently available inexpensively and offers many advantages because of its lightness, excellent thermal insulation and fire resistance.

The exterior of the building may also be protected by cork, or any other sheet insulation system, in this case secured to batons that are secured by nails or screws to the outer side of the OSB boards, after the latter been covered with a layer of air-permeable but water proof paper, such as Tyvek®.

The roof structure of the building may conveniently be formed entirely of solar panels. Conventionally, a solar panel would be mounted above a water tight roof structure, for example a tiled roof, but in an aspect of the invention it is contemplated that the solar panels should themselves act to prevent water from entering the building and that they should be supported in such a manner as to be capable of withstanding the weight of a build-up of snow.

The roof space may be designed to act as a conservatory, in which case the light passing through the solar panels may be allowed to enter the roof space. Alternatively, boards and insulation may be secured to the rafters to provide additional thermal insulation and keep out the light passing through the solar panels.

It may thus be seen that by using beams having accurately pre-mounted stud brackets, the invention allows buildings to be erected accurately and without reliance on skilled labour using standard materials available from a timber yard. In this way, the time from conception to completion can be reduced significantly.

The manufacture of the beams may itself be performed without reliance on skilled labour as it only requires sheet metal to be laser cut and bent. The attachment of the stud brackets to the beams can be performed accurately without reliance on skilled labour as it requires only the insertion of rivets into laser cut holes.

The invention claimed is:

1. A method of constructing a building, comprising:

(a) producing a plurality of studwork wall sections each having upper and lower beams, studs extending vertically between the upper and lower beams and a wall panel secured to the upper and lower beams and to the studs, each wall section being produced by:

(i) providing studs of uniform length, (ii) providing load bearing structural support beams each formed of an elongate metal sheet folded through a right angle about at least one longitudinally extending line to define at least a horizontal first plate, and a vertical second plate to be secured to the wall panel of the studwork wall, each beam having been pre-fitted with a plurality of separately formed sheet metal L-shaped or U-shaped brackets that are permanently secured to at least one of the plates of the folded metal sheet at preset distances from one another along the length of the beam, (iii) supporting two beams, to form the upper and lower beams of the wall section, on a non-vertical surface, (iv) securing a plurality of studs between the two beams by fixing each end of each stud to one of the brackets on a respective one of the beams so that the studs lie parallel to one another, and (v) securing a wall panel to the two beams and to the studs, the dimensions of the wall panel ensuring that the studs and the beams lie at right angles to one another, (b) holding two wall sections in a vertical attitude and mutually inclined planes, (c) securing adjacent lateral edges of the two wall sections to one another to form a self-supporting corner, and (d) securing further wall sections to the self-supporting corner to form a perimeter wall of the building, the sheet metal beams of the perimeter wall serving as an essential structural support element of the building.

2. A method as claimed in claim 1, wherein the step of providing beams includes providing a beam intended to be secured at the upper end of a wall section to serve as a lintel for supporting an upper storey or a roof, wherein the elongate metal sheet is bent to form two horizontal plates and one vertical plate, the brackets for fixing to studs being secured to the lower of the two horizontal plates to project downwards.

3. A method as claimed in claim 2, wherein beams intended to be secured at the upper end of a wall section further include brackets capable of being screwed to joist mounted between and secured to both horizontal plates in vertical alignment with the stud mounting brackets.

4. A method as claimed in claim 1, wherein the step of providing beams includes providing a beam for securing at the lower end of a wall, the beam comprising an elongate metal sheet bent about a longitudinally extending fold line to form horizontal and vertical plates and having brackets for fixing to studs secured to both the horizontal and vertical plates of the metal sheet.

5. A method as claimed in claim 4, wherein the horizontal plate of the beam for securing at the lower end of a wall is further provided with a downwardly bent return along the inwards facing edge to fit over the edge of a foundation wall.

6. A method as claimed in claim 4, wherein holes are formed in the beams to permit passage of pipes and wires.

7. A method as claimed in claim 4, wherein the step of providing beams includes providing a beam intended to be secured at the upper end of a wall section to serve as a lintel for supporting an upper storey or a roof, wherein the elongate metal sheet is bent to form two horizontal plates and one vertical plate, the brackets for fixing to studs being secured to the lower of the two horizontal plates to project downwards.

8. A method as claimed in claim 5, wherein the horizontal plate of the beam extends further from the vertical plate than the stud mounting brackets to provide a region to which a floor may be secured.

9. A method as claimed in claim 5, wherein holes are formed in the beams to permit passage of pipes and wires.

10. A method as claimed in claim 5, wherein the step of providing beams includes providing a beam intended to be secured at the upper end of a wall section to serve as a lintel for supporting an upper storey or a roof, wherein the elongate metal sheet is bent to form two horizontal plates and one vertical plate, the brackets for fixing to studs being secured to the lower of the two horizontal plates to project downwards.

11. A method as claimed in claim 8, wherein holes are formed in the beams to permit passage of pipes and wires.

12. A method as claimed in claim 8, wherein the step of providing beams includes providing a beam intended to be secured at the upper end of a wall section to serve as a lintel for supporting an upper storey or a roof, wherein the elongate metal sheet is bent to form two horizontal plates and one vertical plate, the brackets for fixing to studs being secured to the lower of the two horizontal plates to project downwards.

13. A method as claimed in claim 1, wherein holes are formed in the beams to permit passage of pipes and wires.

* * * * *